US010757513B1

(12) United States Patent
Chen et al.

(10) Patent No.: US 10,757,513 B1
(45) Date of Patent: Aug. 25, 2020

(54) ADJUSTMENT METHOD OF HEARING AUXILIARY DEVICE

(71) Applicant: Compal Electronics, Inc., Taipei (TW)

(72) Inventors: Yi-Ching Chen, Taipei (TW); Yun-Chiu Ching, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 16/421,246

(22) Filed: May 23, 2019

(30) Foreign Application Priority Data

Apr. 11, 2019 (TW) ..... 108112773 A

(51) Int. Cl.
*H04R 25/00* (2006.01)

(52) U.S. Cl.
CPC ..... *H04R 25/50* (2013.01); *H04R 25/40* (2013.01); *H04R 25/70* (2013.01)

(58) Field of Classification Search
CPC ..... H04R 25/50; H04R 25/40; H04R 25/70
See application file for complete search history.

(56) References Cited

U.S. PATENT DOCUMENTS 9,824,698 B2 * 11/2017 Jerauld ..... A61B 5/11
9,934,697 B2 * 4/2018 O'Dowd ..... G06F 3/011
10,108,984 B2 * 10/2018 Baldwin ..... G06Q 30/0269
2006/0031288 A1 * 2/2006 Ter Horst ..... G06F 16/9535 709/204
2010/0228696 A1 * 9/2010 Sim ..... G06N 3/004 706/52
2011/0295843 A1 * 12/2011 Ingrassia, Jr. ..... G06F 16/4387 707/723
2012/0308971 A1 * 12/2012 Shin ..... G08B 31/00 434/236
2013/0095460 A1 * 4/2013 Bishop ..... G09B 19/00 434/308

(Continued)

FOREIGN PATENT DOCUMENTS

CN 105432096 A 3/2016
CN 105580389 A 5/2016

(Continued)

*Primary Examiner* — Oyesola C Ojo
(74) *Attorney, Agent, or Firm* — Kirton McConkie; Evan R. Witt

(57) ABSTRACT

An adjustment method of a hearing auxiliary device includes steps of (a) providing a context awareness platform and a hearing auxiliary device, (b) acquiring an activity and emotion information and inputting the activity and emotion information to the context awareness platform, (c) acquiring a scene information and inputting the scene information to the context awareness platform, (d) obtaining a sound adjustment suggestion according to the activity and emotional information and the scene information, (e) determining whether a response of a user to the sound adjustment suggestion meets expectation, and (f) when the judgment result of the step (e) is TRUE, transmitting the sound adjustment suggestion to the hearing auxiliary device and adjusting the hearing auxiliary device according to the sound adjustment suggestion. Therefore, the hearing auxiliary device can be appropriately adjusted to meet the demands and correctly and effectively adjusted without any assistance of a professional.

11 Claims, 7 Drawing Sheets

(56) References Cited

U.S. PATENT DOCUMENTS

| | | | | |
|---|---|---|---|---|
| 2013/0243227 | A1* | 9/2013 | Kinsbergen | H04R 25/70 381/314 |
| 2015/0162000 | A1* | 6/2015 | Di Censo | G06F 16/433 704/270.1 |
| 2015/0177939 | A1* | 6/2015 | Anderson | G06F 3/017 715/745 |
| 2015/0195641 | A1* | 7/2015 | Di Censo | H04R 1/1083 381/71.6 |
| 2017/0347205 | A1 | 11/2017 | Aschoff | |

FOREIGN PATENT DOCUMENTS

| | | | |
|---|---|---|---|
| TW | M510020 | U | 10/2015 |
| TW | 201615036 | A | 4/2016 |
| TW | 201703025 | A | 1/2017 |

* cited by examiner

ADJUSTMENT METHOD OF HEARING AUXILIARY DEVICE

CROSS-REFERENCE TO RELATED APPLICATION

This application claims priority from Taiwan Patent Application No. 108112773, filed on Apr. 11, 2019, the entire contents of which are incorporated herein by reference for all purposes.

FIELD OF THE INVENTION

The present invention relates to an adjustment method, and more particularly to an adjustment method of a hearing auxiliary device.

BACKGROUND OF THE INVENTION

Hearing is a very personal feeling, and auditory responses and feelings of each person are different. In general, various hearing auxiliary devices commonly used on the market, such as hearing aids, require professionals to adjust and set the hearing auxiliary device according to the experiences of the professionals and the questions described by the user. However, as mentioned above, hearing is a personal feeling, it is more difficult to dictate the complete presentation, and the communication between the user and the professional spends a lot of time.

Most of the present hearing auxiliary devices are appropriately selected through the assistance of the professionals. When the user has a need to adjust the hearing auxiliary device, the user has to come back to the store and ask the professionals to help. However, it is difficult for a user to find a problem and give feedback as soon as the hearing auxiliary device is adjusted. It is also necessary to spend time and energy learning how to adjust for finding a suitable setting for his or her own hearing. It is time consuming and cannot reach the best results. Even if some parameters can be adjusted by an application that can be installed on a computer or a smart phone, such as adjusting the equalizer and volume, the user still needs to spend a lot of time learning the changes brought by the parameters and finding the direction of the parameter adjustment. It is more likely that the user feels wrong but does not know how to adjust, which in turn leads to frustration and even loses confidence in the hearing auxiliary device.

Therefore, there is a need of providing an adjustment method of a hearing auxiliary device distinct from the prior art in order to solve the above drawbacks.

SUMMARY OF THE INVENTION

Some embodiments of the present invention are to provide an adjustment method of a hearing auxiliary device in order to overcome at least one of the above-mentioned drawbacks encountered by the prior arts.

The present invention provides an adjustment method of a hearing auxiliary device. Since the sound adjustment is performed and the user response is determined by the context awareness platform according to the activity and emotional information and the scene information, the hearing auxiliary device can be appropriately adjusted to meet the demands of the user, such that the hearing auxiliary device can be correctly and effectively adjusted without any assistance of a professional.

The present invention also provides an adjustment method of a hearing auxiliary device. By collecting the environment in which the user is located and the auditory response of the user, the suitable auditory setting can be determined in response to the relevant of the current environment and the auditory response of the user, such that the discomfort and inconvenience of the user using the hearing auxiliary device can be reduced.

In accordance with an aspect of the present invention, there is provided an adjustment method of a hearing auxiliary device. The adjustment method includes steps of (a) providing a context awareness platform and a hearing auxiliary device, (b) acquiring an activity and emotion information and inputting the activity and emotion information to the context awareness platform, (c) acquiring a scene information and inputting the scene information to the context awareness platform, (d) obtaining a sound adjustment suggestion according to the activity and emotional information and the scene information, (e) determining whether a response of a user to the sound adjustment suggestion meets expectation, and (f) when the judgment result of the step (e) is TRUE, transmitting the sound adjustment suggestion to the hearing auxiliary device and adjusting the hearing auxiliary device according to the sound adjustment suggestion.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
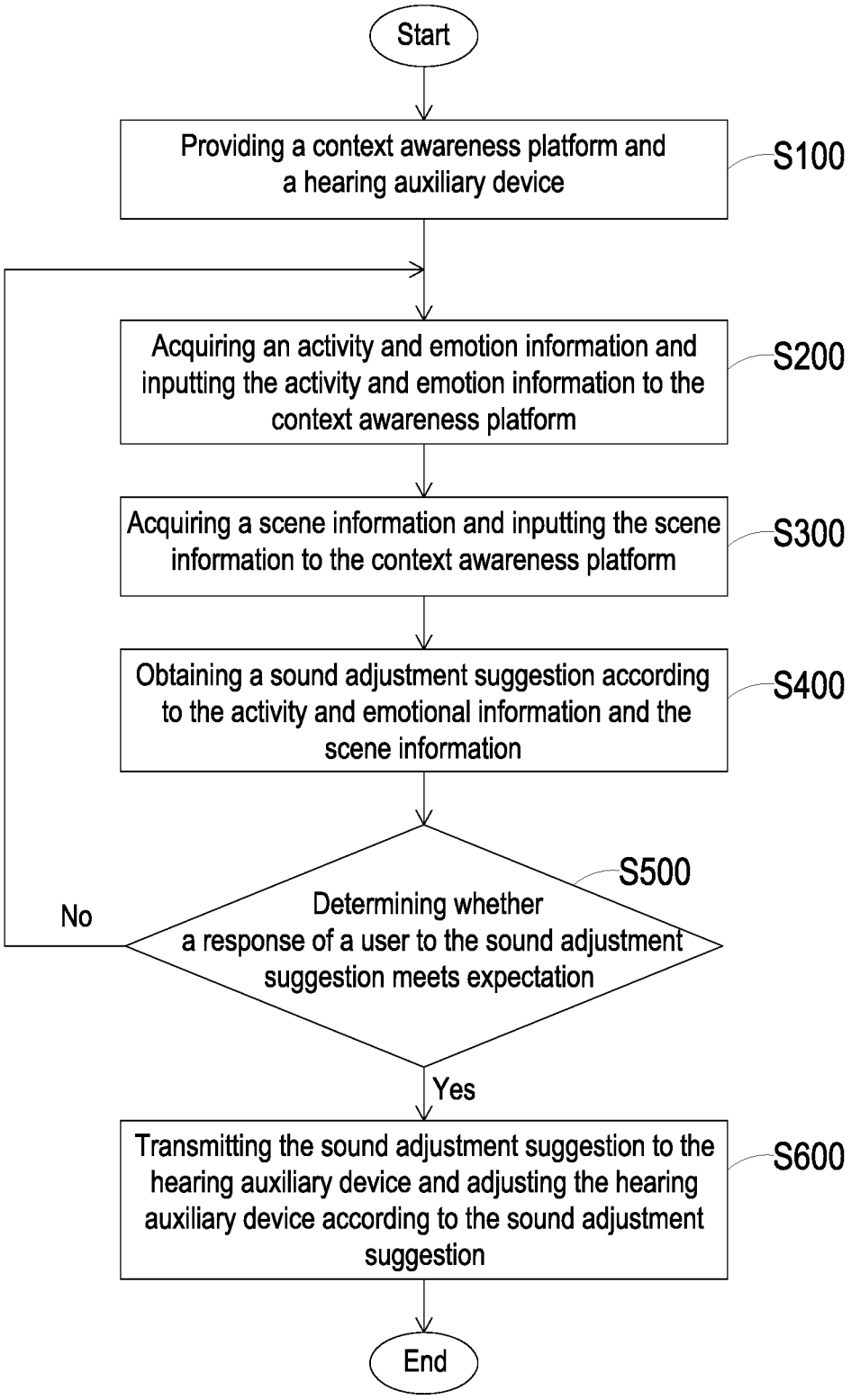
FIG. 1 schematically illustrates the flow chart of an adjustment method of a hearing auxiliary device according to an embodiment of the present invention.
Figure 2:
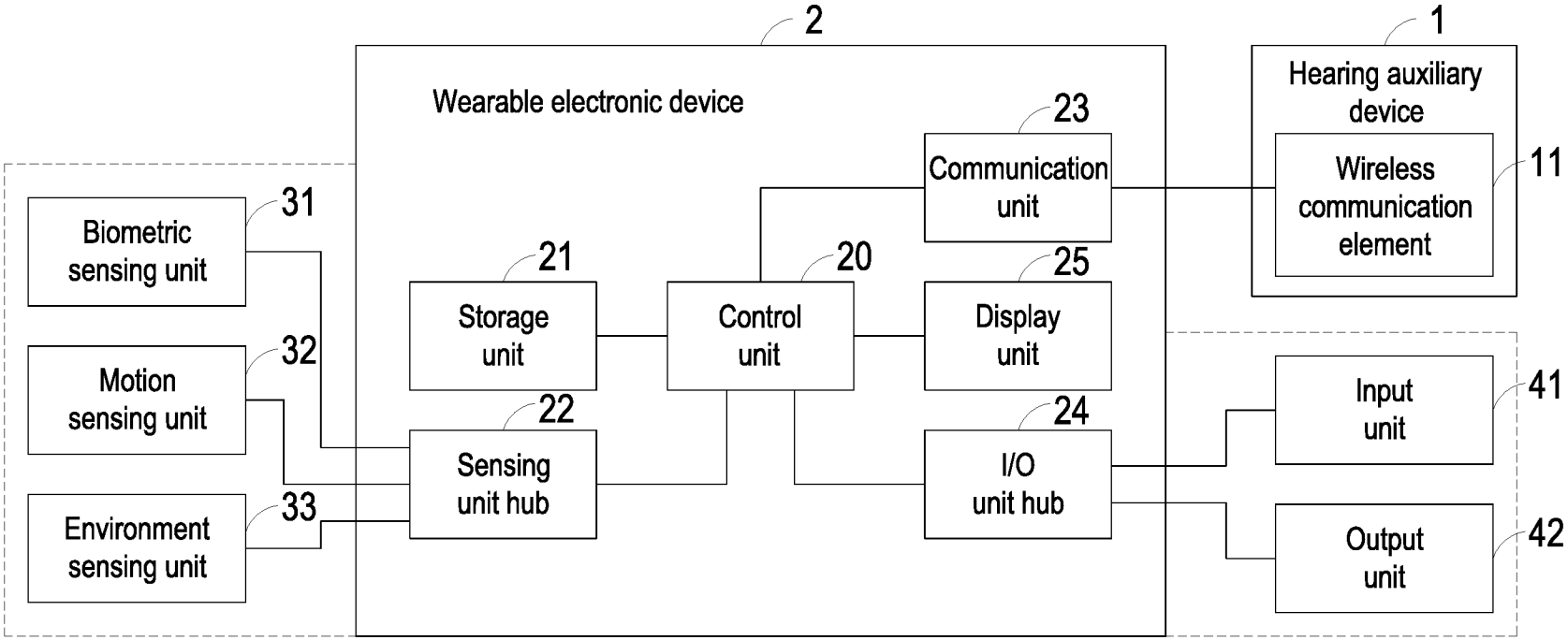
FIG. 2 schematically illustrates the configurations of a wearable electronic device and a hearing auxiliary device according to an embodiment of the present invention.

Please refer to FIG. 1 and FIG. 2. FIG. 1 schematically illustrates the flow chart of an adjustment method of a hearing auxiliary device according to an embodiment of the present invention. FIG. 2 schematically illustrates the configurations of a wearable electronic device and a hearing auxiliary device according to an embodiment of the present invention. As shown in FIG. 1 and FIG. 2, an adjustment method of a hearing auxiliary device according to an embodiment of the present invention includes steps as follows. Firstly, as shown in step S100, providing a context awareness platform and a hearing auxiliary device 1. Next, as shown in step S200, acquiring an activity and emotion information and inputting the activity and emotion information to the context awareness platform. Then, as shown in step S300, acquiring a scene information and inputting the scene information to the context awareness platform. Next, as shown in step S400, obtaining a sound adjustment suggestion according to the activity and emotional information and the scene information through a relevant mapping. In other words, the sound adjustment suggestion can be obtained according to a relevant value of the activity and emotional information and the scene information. Next, as show in step S500, determining whether a response of a user to the sound adjustment suggestion meets expectation (i.e. determining if the response of the user is positive). For example, when an auditory feedback vector of the user is calculated in the step S400, it can be determined if the auditory feedback vector becomes more concentrate in the step S500 after the adjustment, but not limited thereto. When the judgment result of the step S500 is TRUE, a step S600 of transmitting the sound adjustment suggestion to the hearing auxiliary device 1 and adjusting the hearing auxiliary device 1 according to the sound adjustment suggestion is performed after the step S500. In addition, when the judgment result of the step S500 is FALSE, the step S200 to the step S500 are re-performed after the step S500. Therefore, the adjustment can be repeatedly performed to meet the demands of the user, such that the advantages of correctly and effectively adjusting the hearing auxiliary device without any assistance of a professional is achieved.

In some embodiments, the context awareness platform can be stored in and operated on a wearable electronic device 2 or an electronic device with computing functions, in which the former can be a smart watch, a smart wristband or a smart eyeglass, and the latter can be a personal computer, a tablet PC or a smart phone, but not limited thereto. In an embodiment, taking the wearable electronic device 2 for example and illustration. The wearable electronic device 2 includes a control unit 20, a storage unit 21, a sensing unit hub 22, a communication unit 23, an input/output unit hub 24 and a display unit 25. The control unit 20 is configured to operate the context awareness platform. The storage unit 21 is connected with the control unit 20, and the context awareness platform can be stored in the storage unit 21. The storage unit 21 may include a non-volatile storage unit such as a solid-state drive or a flash memory, and may include a volatile storage unit such as a DRAM or the like, but not limited thereto. The sensing unit hub 22 is connected with the control unit 20. The sensing unit hub 22 can be utilized as merely a hub connected with a plurality of sensors, or be integrated with the sensors, and a sensor fusion platform and/or an environment analysis and scene detection platform. For example, the sensor fusion platform and/or the environment analysis and scene detection platform can be implemented in manners of hardware chips or software applications, but not limited thereto.

In some embodiments, the sensors connected with the sensing unit hub 22 include a biometric sensing unit 31, a motion sensing unit 32 and an environment sensing unit 33, but not limited thereto. The biometric sensing unit 31, the motion sensing unit 32 and the environment sensing unit 33 can be independent from the wearable electronic device 2, installed in another device, or integrated with the wearable electronic device 2.

In addition, the communication unit 23 is connected with the control unit 20. The communication unit 23 is communicated with a wireless communication element 11 of the hearing auxiliary device 1. The input/output (I/O) unit hub 24 is connected with the control unit 20, and the I/O unit hub 24 can be connected with and integrated with an input unit 41 and an output unit 42, in which the input unit can be a microphone, and the output unit 42 can be a speaker, but not limited thereto. The display unit 25 is connected with the control unit 20 to implement the display of the content needed for the wearable electronic device 2 itself. In some embodiments, the step S200 of the adjustment method of the hearing auxiliary device is preferably implemented through the control unit 20 and the sensing unit hub 22. The step S300 and the step S500 are preferably implemented through the control unit 20, the sensing unit hub 22 and the I/O unit hub 24. The step S400 is preferably implemented through the control unit 20. The step S600 is preferably implemented through the control unit 20 and the communication unit 23.

Figure 3:
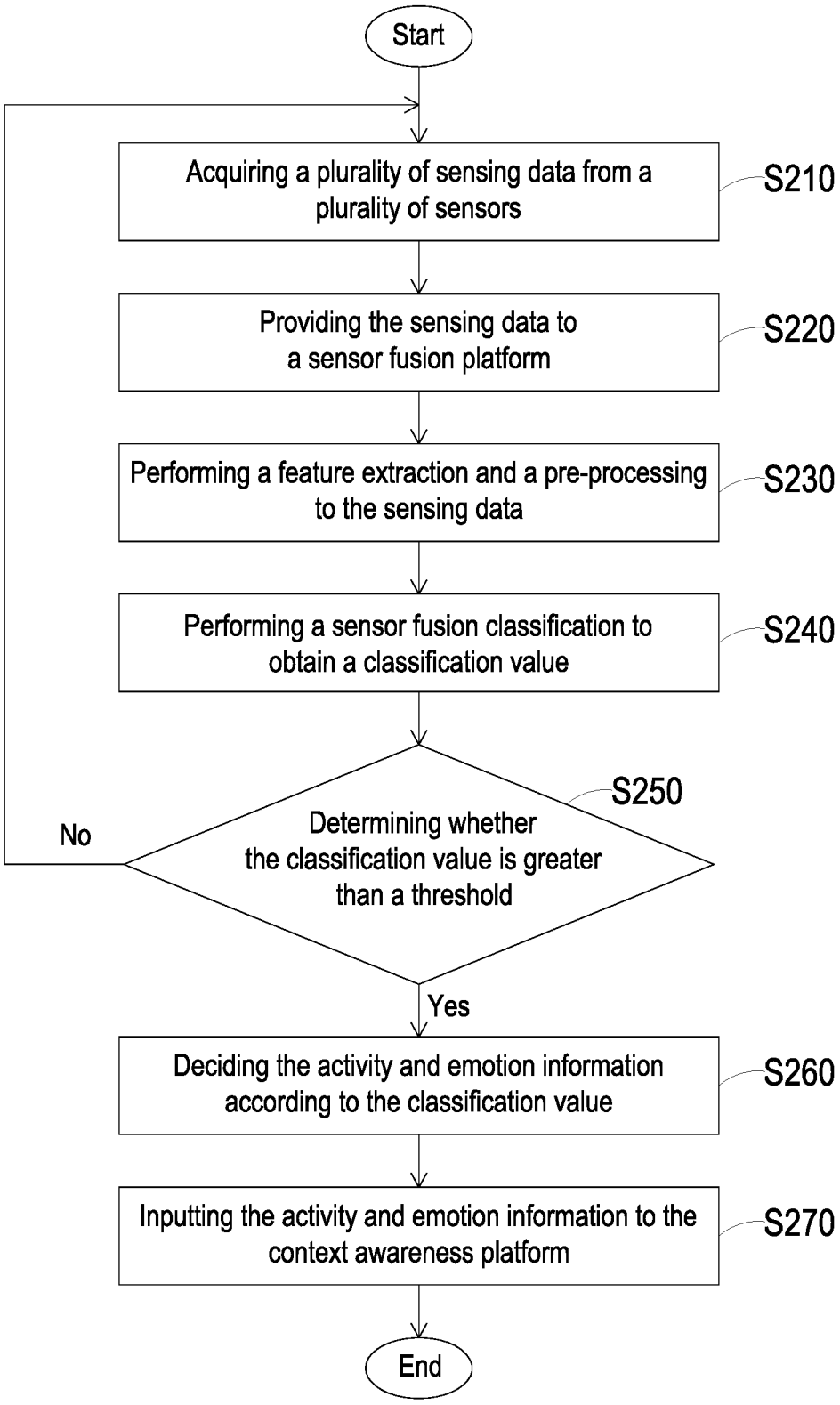
FIG. 3 schematically illustrates the detailed flow chart of the step S200 shown in FIG. 1.
Figure 4:
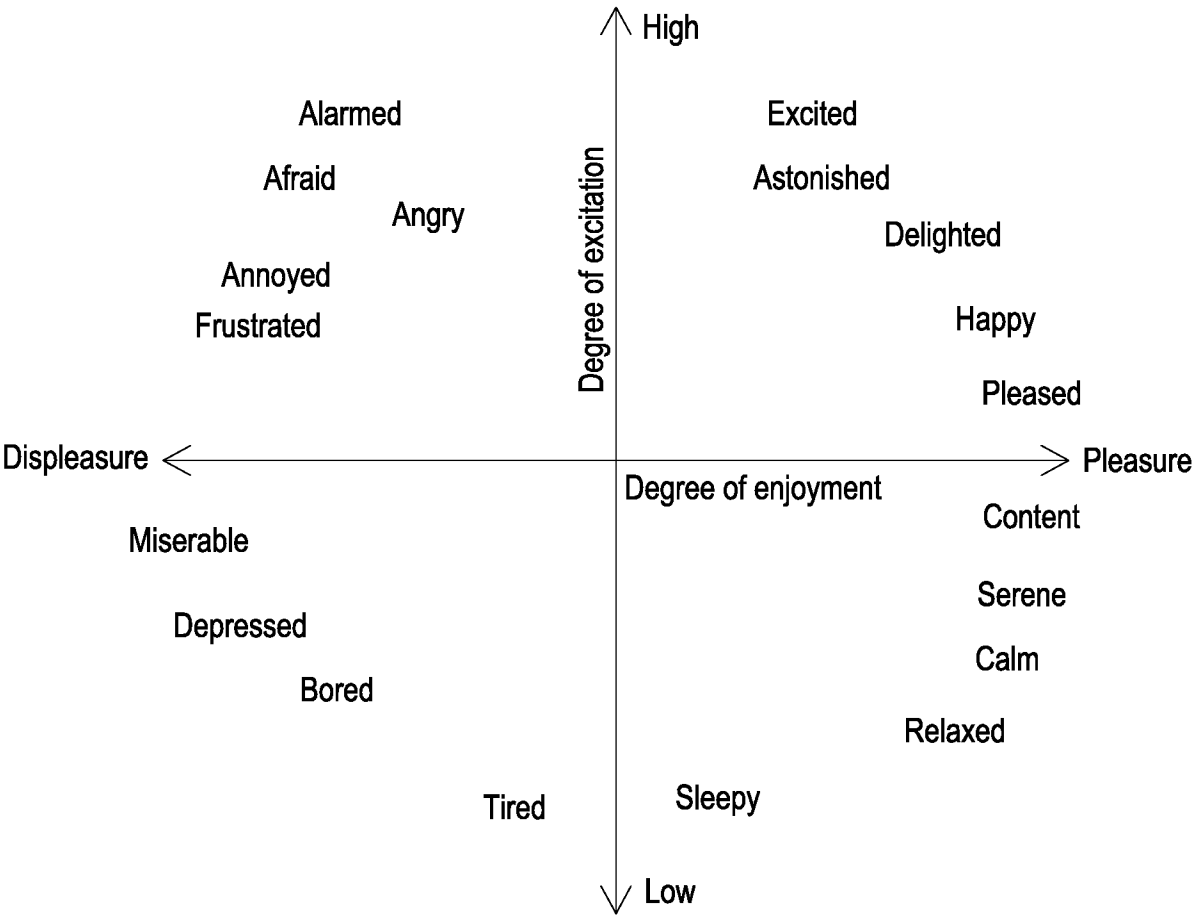
FIG. 4 schematically illustrates a two-dimensional scale describing a degree of excitation and a degree of enjoyment.

Please refer to FIG. 1, FIG. 2, FIG. 3 and FIG. 4. FIG. 3 schematically illustrates the detailed flow chart of the step S200 shown in FIG. 1. FIG. 4 schematically illustrates a two-dimensional scale describing a degree of excitation and a degree of enjoyment. As shown in FIGS. 1-4, the step S200 of the adjustment method of the hearing auxiliary device includes sub-steps as follows. Firstly, as shown in sub-step S210, acquiring a plurality of sensing data from a plurality of sensors. Next, as shown in sub-step S220, providing the sensing data to a sensor fusion platform. Then, as shown in sub-step S230, performing a feature extraction and a preprocessing to the sensing data, in which the former can extract features such as waveforms or frequencies generated by a plurality of sensing data, and the latter can preprocess background noise of a plurality of sensing data, but not limited thereto. Then, as shown in sub-step S240, performing a sensor fusion classification to obtain a classification value. Next, as shown in sub-step S250, determining whether the classification value is greater than a threshold. When the judgment result of the sub-step S250 is TRUE, sub-step S260 of deciding the activity and emotion information according to the classification value and sub-step S270 of inputting the activity and emotion information to the context awareness platform are performed after the sub-step S250. On the other hand, when the judgment result of the sub-step S250 is FALSE, the sub-step S210 to the sub-step S250 are re-performed after the sub-step S250. In this embodiment, the sensor fusion classification, the classification value and the threshold are decided according to a physiological scale, and the physiological scale is a two-dimensional scale describing a degree of excitation and a degree of enjoyment (e.g. the two-dimensional scale shown in FIG. 4). The physiological scale can be a scale based on psychology and statistics after big data statistics and machine learning. By collecting the environment in which the user is located and the auditory response of the user, it can be seen whether the physiological response of the user corresponds to the environment correctly so as to realize whether the user has correctly received the sound and make subsequent adjustments.

For example, the correct physiological response during a speech should be biased between the first quadrant and the second quadrant of the two-dimensional scale shown in FIG. 4, and the correct physiological response at a concert should be biased towards the fourth quadrant. If the physiological response of the user does not match with the expected scene, it represents that a sound adjustment should be performed. For example, when the physiological response of the user is biased to the third quadrant during the speech, the vocal related parameters should be strengthened, and then the physiological response of the user should be observed to realize whether the physiological response shifts toward the first quadrant and/or the second quadrant.

In some embodiments, the sensors include two of a six-axis motion sensor, a gyroscope sensor, a global positioning system sensor, an altimeter sensor, a heartbeat sensor, a barometric sensor, and a blood-flow sensor. The plurality of sensing data are obtained through the plurality of the sensors. The sensing data include two of motion data, displacement data, global positioning system data, height data, heartbeat data, barometric data and blood-flow data. The sensors can be connected with the sensing unit hub 22.

Figure 5:
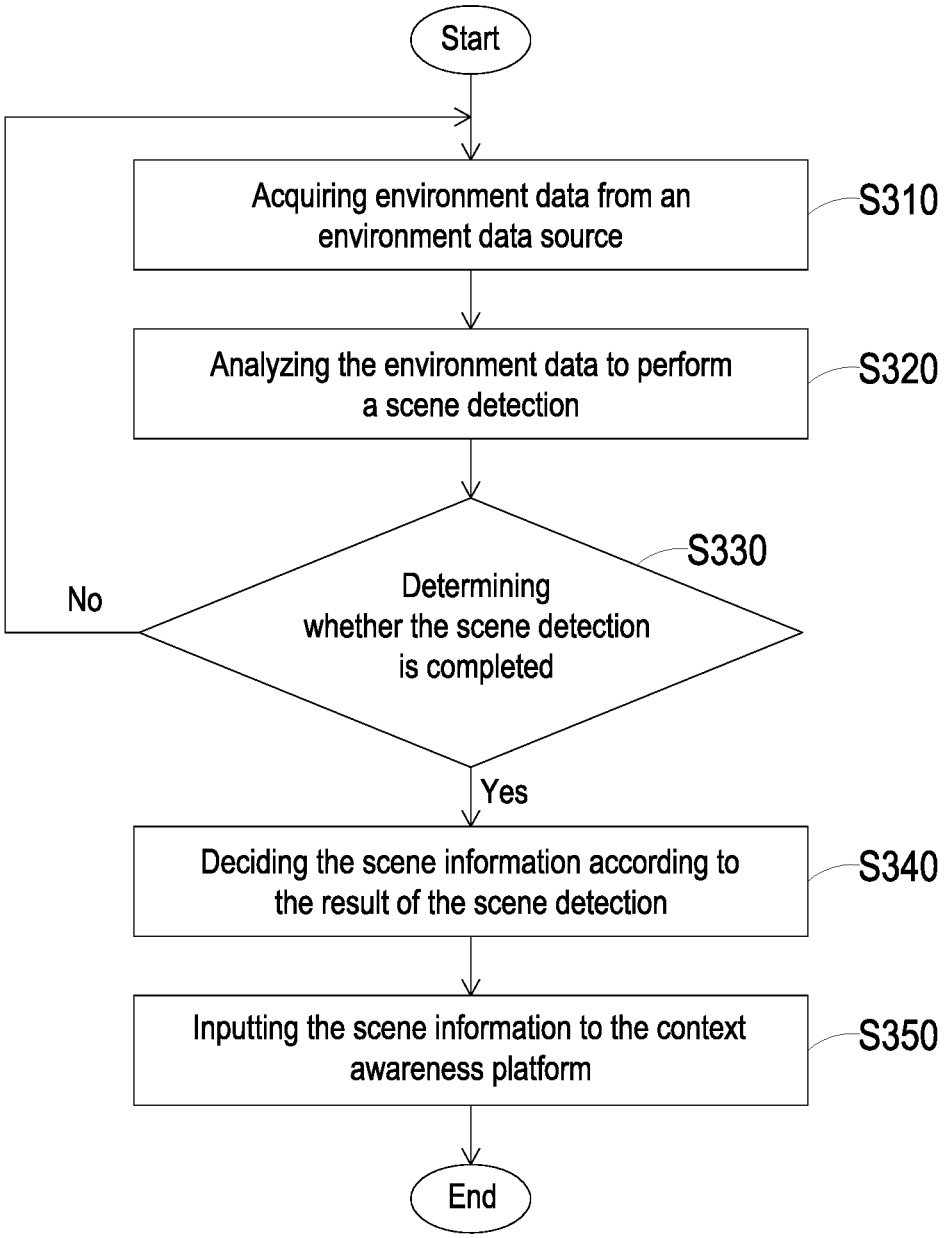
FIG. 5 schematically illustrates the detailed flow chart of the step S300 shown in FIG. 1.

Please refer to FIG. 1, FIG. 2 and FIG. 5. FIG. 5 schematically illustrates the detailed flow chart of the step S300 shown in FIG. 1. As shown in FIG. 1, FIG. 2 and FIG. 5, the step S300 of the adjustment method of the hearing auxiliary device includes sub-steps as follows. Firstly, as shown in sub-step S310, acquiring environment data from an environment data source. Next, as shown in sub-step S320, analyzing the environment data to perform a scene detection. Then, as shown in sub-step S330, determining whether the scene detection is completed. When the judgement result of the sub-step S330 is TRUE, sub-step S340 of deciding the scene information according to the result of the scene detection and sub-step S350 of inputting the scene information to the context awareness platform are performed after the sub-step S330. On the other hand, when the judgement result of the sub-step S330 is FALSE, the sub-step S310 to the sub-step S330 are re-performed after the sub-step S330.

In some embodiments, the environment data source mentioned in the step S310 includes one of a global positioning system sensor, an optical sensor, a microphone, a camera and a communication unit. Moreover, it is worthy noted that the sub-step S320 to the sub-step S330 can be implemented through providing the environment data to the environment analysis and scene detection platform for analyzing and determining, but not limited thereto.

Figure 6:
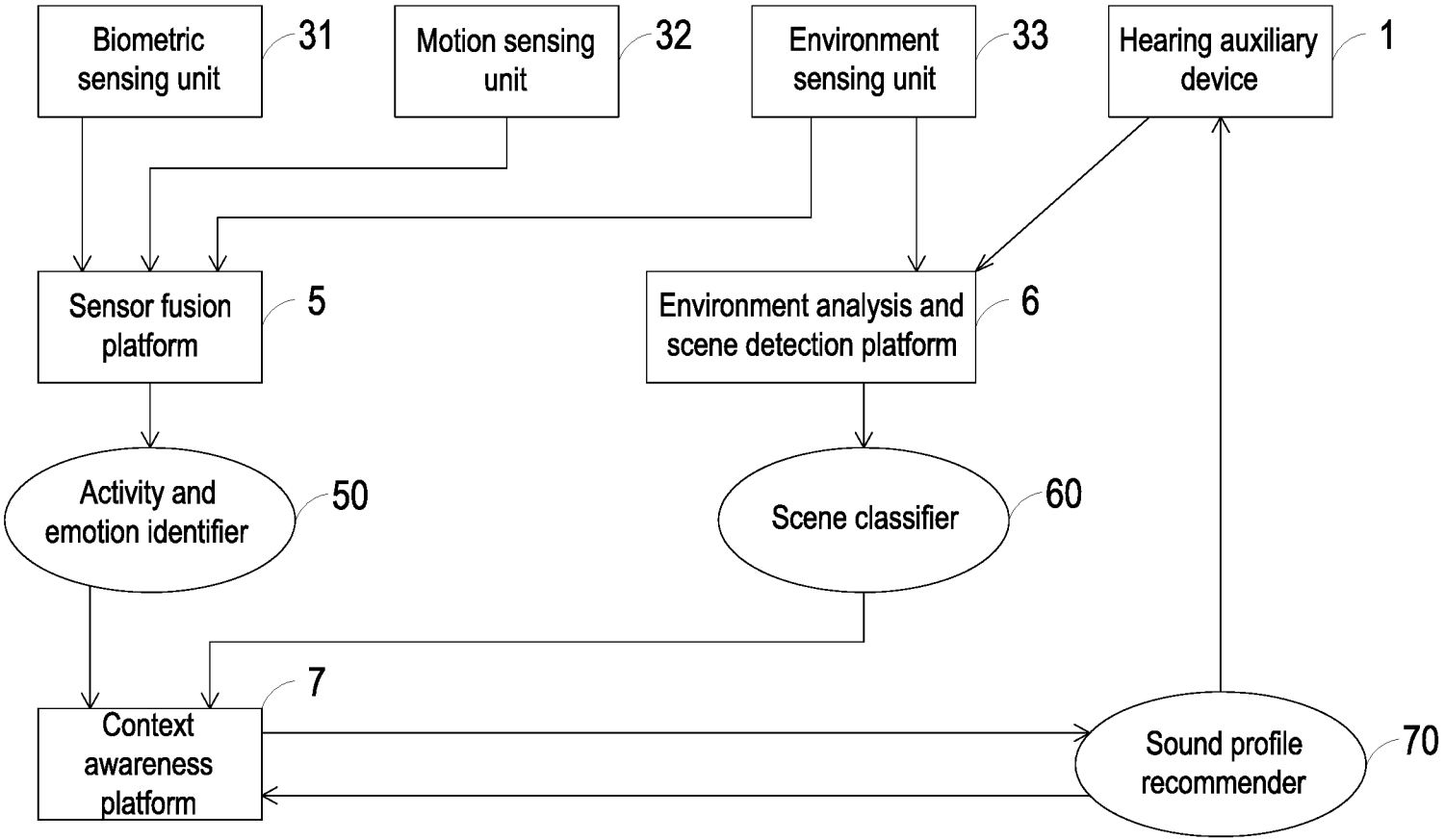
FIG. 6 schematically illustrates the flow configuration of an adjustment method of a hearing auxiliary device according to an embodiment of the present invention.

Please refer to FIG. 1 to FIG. 6. FIG. 6 schematically illustrates the flow configuration of an adjustment method of a hearing auxiliary device according to an embodiment of the present invention. As shown in FIGS. 1-6, according to the flow configuration of the adjustment method of the hearing auxiliary device, a sensor fusion platform 5 and an environment analysis and scene detection platform 6 mentioned above can be hardware chips integrated with the sensing unit hub 22, or can be software applications operated through the control unit 20, but not limited thereto.

Additionally, the sub-step S260, which is described in the above-mentioned embodiments, of deciding the activity and emotion information according to the classification value, can be executed through an activity and emotion identifier 50. The activity and emotion identifier can be an application or an algorithm. Likewise, the sub-step S340, which is described in the above-mentioned embodiments, of deciding the scene information according to the result of the scene detection, can be executed through a scene classifier 60. The scene classifier can be an application or an algorithm. Similarly, the steps S400-S600 of the adjustment method of the present invention can be executed through a context awareness platform 7 and a sound profile recommender 70. The context awareness platform 7 can be implemented in manners of hardware chips or software applications, and the sound profile recommender 70 can be an application or an algorithm.

It should be noted that the sensor fusion platform 5, the environment analysis and scene detection platform 6, the context awareness platform 7, the activity and emotion identifier 50, the scene classifier 60 and the sound profile recommender 70 can be all existed in for example the wearable electronic device 2 as shown in FIG. 2, or existed in another electronic devices with computing functions. The substantial existing positions of them can be varied corresponding to the configuration of the wearable electronic device 2 or the electronic devices with computing functions. It is all in the scope of teaching of the present invention.

Figure 7:
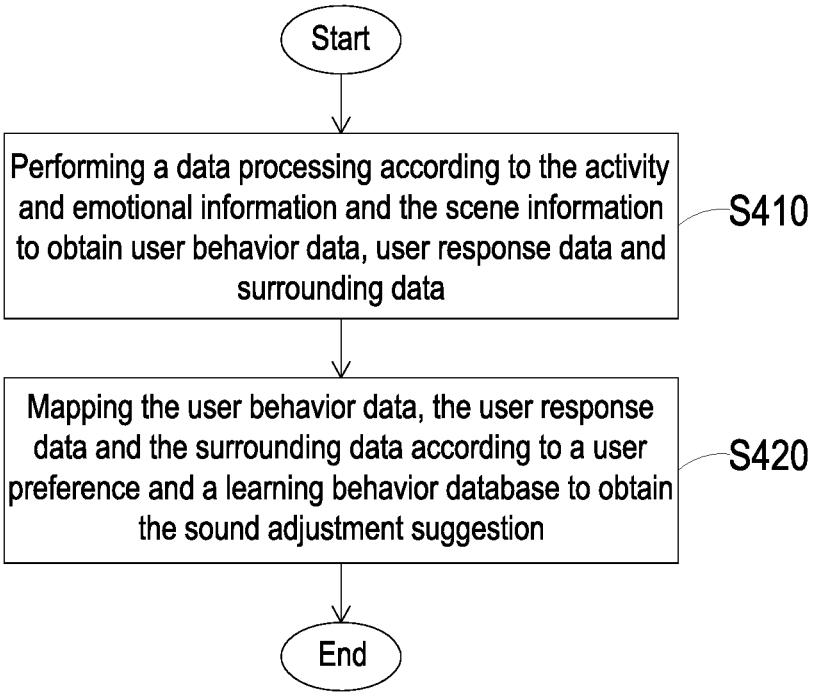
FIG. 7 schematically illustrates the detailed flow chart of the step S400 shown in FIG. 1.

Please refer to FIG. 1, FIG. 2 and FIG. 7. FIG. 7 schematically illustrates the detailed flow chart of the step S400 shown in FIG. 1. As shown in FIG. 1, FIG. 2 and FIG. 7, the step S400 of the adjustment method of the hearing auxiliary device includes sub-steps as follows. Firstly, as shown in sub-step S410, performing a data processing according to the activity and emotional information and the scene information to obtain user behavior data, user response data and surrounding data. Next, as shown in sub-step S420, mapping the user behavior data, the user response data and the surrounding data according to a user preference and a learning behavior database to obtain the sound adjustment suggestion. Under this circumstance, the more detailed the referenced data, the better the accuracy of the sound adjustment suggestion.

From the above description, the present invention provides an adjustment method of a hearing auxiliary device. Since the sound adjustment is performed and the user response is determined by the context awareness platform according to the activity and emotional information and the scene information, the hearing auxiliary device can be appropriately adjusted to meet the demands of the user, such that the hearing auxiliary device can be correctly and effectively adjusted without any assistance of a professional. Meanwhile, by collecting the environment in which the user is located and the auditory response of the user, the suitable auditory setting can be determined in response to the relevant of the current environment and the auditory response of the user, such that the discomfort and inconvenience of the user using the hearing auxiliary device can be reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An adjustment method of a hearing auxiliary device, comprising steps of:

(a) providing a context awareness platform and a hearing auxiliary device;

(b) acquiring an activity and emotion information and inputting the activity and emotion information to the context awareness platform;

(c) acquiring a scene information and inputting the scene information to the context awareness platform;

(d) obtaining a sound adjustment suggestion according to the activity and emotional information and the scene information;

(e) determining whether a response of a user to the sound adjustment suggestion meets expectation; and (f) when the judgment result of the step (e) is TRUE, transmitting the sound adjustment suggestion to the hearing auxiliary device and adjusting the hearing auxiliary device according to the sound adjustment suggestion, wherein the context awareness platform is stored in a wearable electronic device, and the wearable electronic device comprises:

a control unit configured to operate the context awareness platform, a storage unit connected with the control unit;

a sensing unit hub connected with the control unit;

a communication unit connected with the control unit, wherein the communication unit is communicated with a wireless communication element of the hearing auxiliary device, and an input/output unit hub connected with the control unit, wherein the step (b) is implemented through the control unit and the sensing unit hub, the step (c) and the step (e) are implemented through the control unit, the sensing unit hub and the input/output unit hub, the step (d) is implemented through the control unit, and the step (f) is implemented through the control unit and the communication unit.

2. The adjustment method according to claim 1, wherein the step (b) comprising sub-steps of:

(b1) acquiring a plurality of sensing data from a plurality of sensors;

(b2) providing the sensing data to a sensor fusion platform;

(b3) performing a feature extraction and a pre-processing to the sensing data;

(b4) performing a sensor fusion classification to obtain a classification value;

(b5) determining whether the classification value is greater than a threshold;

(b6) deciding the activity and emotion information according to the classification value; and (b7) inputting the activity and emotion information to the context awareness platform, wherein when the judgment result of the sub-step (b5) is TRUE, the sub-step (b6) and the sub-step (b7) are performed after the sub-step (b5), and when the judgment result of the sub-step (b5) is FALSE, the sub-step (b1) to the sub-step (b5) are re-performed after the sub-step (b5).

3. The adjustment method according to claim 2, wherein the sensors comprise a biometric sensing unit, a motion sensing unit and an environment sensing unit.

4. The adjustment method according to claim 2, wherein the sensors comprise two of a six-axis motion sensor, a gyroscope sensor, a global positioning system sensor, an altimeter sensor, a heartbeat sensor, a barometric sensor, and a blood-flow sensor.

5. The adjustment method according to claim 2, wherein the sensing data comprise two of motion data, displacement data, global positioning system data, height data, heartbeat data, barometric data and blood-flow data.

6. The adjustment method according to claim 2, wherein the sensor fusion classification, the classification value and the threshold are decided according to a physiological scale, and the physiological scale is a two-dimensional scale describing a degree of excitation and a degree of enjoyment.

7. The adjustment method according to claim 1, wherein the step (c) comprises sub-steps of:

(c1) acquiring environment data from an environment data source;

(c2) analyzing the environment data to perform a scene detection;

(c3) determining whether the scene detection is completed;

(c4) deciding the scene information according to the result of the scene detection; and (c5) inputting the scene information to the context awareness platform, wherein when the judgement result of the sub-step (c3) is TRUE, the sub-step (c4) and the sub-step (c5) are performed after the sub-step (c3).

8. The adjustment method according to claim 7, wherein when the judgement result of the sub-step (c3) is FALSE, the sub-step (c1) to the sub-step (c3) are re-performed after the sub-step (c3).

9. The adjustment method according to claim 7, wherein the environment data source comprises one of a global positioning system sensor, an optical sensor, a microphone, a camera and a communication unit.

10. The adjustment method according to claim 1, wherein the step (d) comprises sub-steps of:

(d1) performing a data processing according to the activity and emotional information and the scene information to obtain user behavior data, user response data and surrounding data; and (d2) mapping the user behavior data, the user response data and the surrounding data according to a user preference and a learning behavior database to obtain the sound adjustment suggestion.

11. The adjustment method according to claim 1, wherein when the judgement result of the step (e) is FALSE, the step (b) to the step (e) are re-performed after the sub-step (e).

* * * * *